US005774558A

United States Patent [19]

Drucker

[11] Patent Number: 5,774,558

[45] Date of Patent: Jun. 30, 1998

[54] SOUND IMAGER

[75] Inventor: Doris Drucker, Claremont, Calif.

[73] Assignee: RSQ, LLC, Claremont, Calif.

[21] Appl. No.: 736,197

[22] Filed: Oct. 24, 1996

Related U.S. Application Data

[60] Provisional application No. 60/007,257 Nov. 6, 1995.

[51] Int. Cl.[6] ..... H04R 29/00

[52] U.S. Cl. ..... 381/56; 340/573; 381/58

[58] Field of Search ..... 381/56, 58, 77, 381/104, 82; 340/529, 540, 573, 326

[56] References Cited

U.S. PATENT DOCUMENTS

| | | | |
|---|---|---|---|
| 2,486,890 | 11/1949 | Stanmyre . | |
| 2,593,204 | 4/1952 | Schwartzberg . | |
| 2,969,530 | 1/1961 | Duncan | 381/56 |
| 3,597,542 | 8/1971 | Thornton . | |
| 4,124,895 | 11/1978 | Takise et al. . | |
| 4,277,980 | 7/1981 | Coats et al. . | |
| 4,346,374 | 8/1982 | Groff | 381/56 |
| 4,424,511 | 1/1984 | Alberts | 381/56 |
| 4,706,270 | 11/1987 | Lin . | |
| 5,365,219 | 11/1994 | Wong | 381/56 |
| 5,390,248 | 2/1995 | Segan | 381/56 |

*Primary Examiner*—Minsun Oh Harvey
*Attorney, Agent, or Firm*—Wagner & Middlebrook

[57] ABSTRACT

An apparatus for the representation of the sound of the human voice as an image in which individual colors correspond to distinct loudness levels. Sound received by a transducer is converted into electric signals, amplified, processed and transmitted to light emitting diodes which are arrayed in groups according to the color of the light they are emitting. Different groups are programmed to emit light when they are energized by signals reflecting different loudness levels. The display in which the colors change as the loudness varies provides a continuous feedback in real time by showing a speaker instantaneously how loud he speaks.

12 Claims, 2 Drawing Sheets

FIG. 1
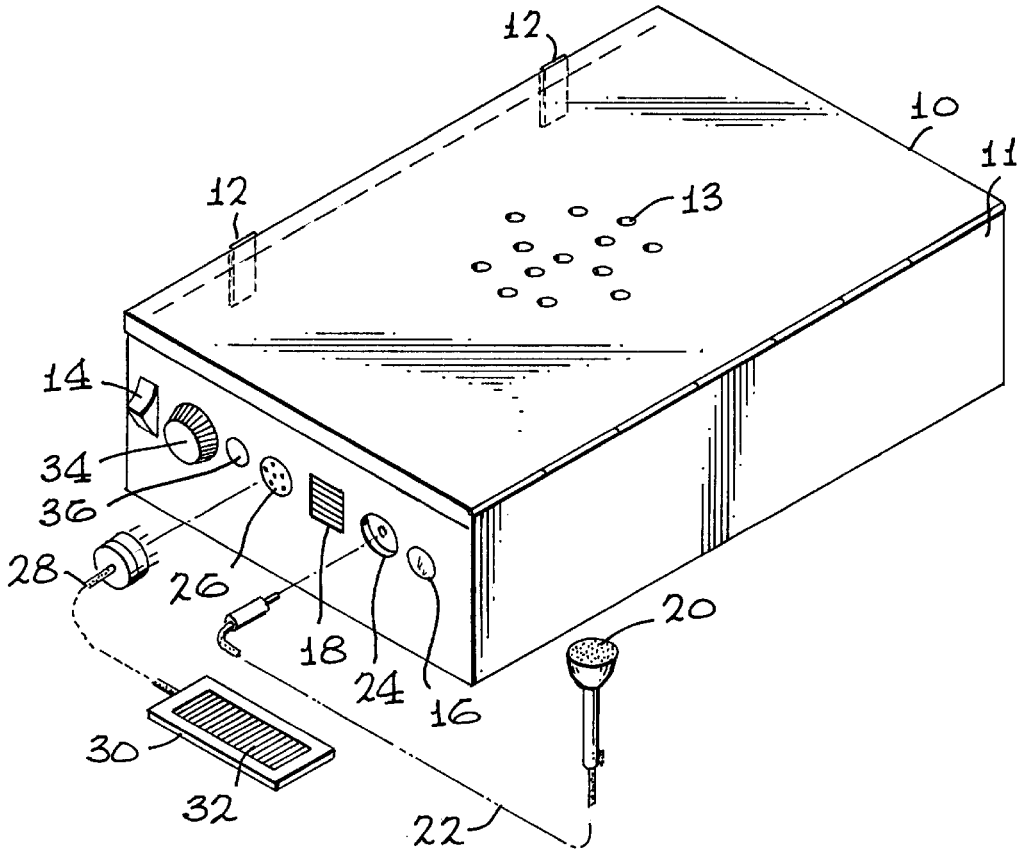
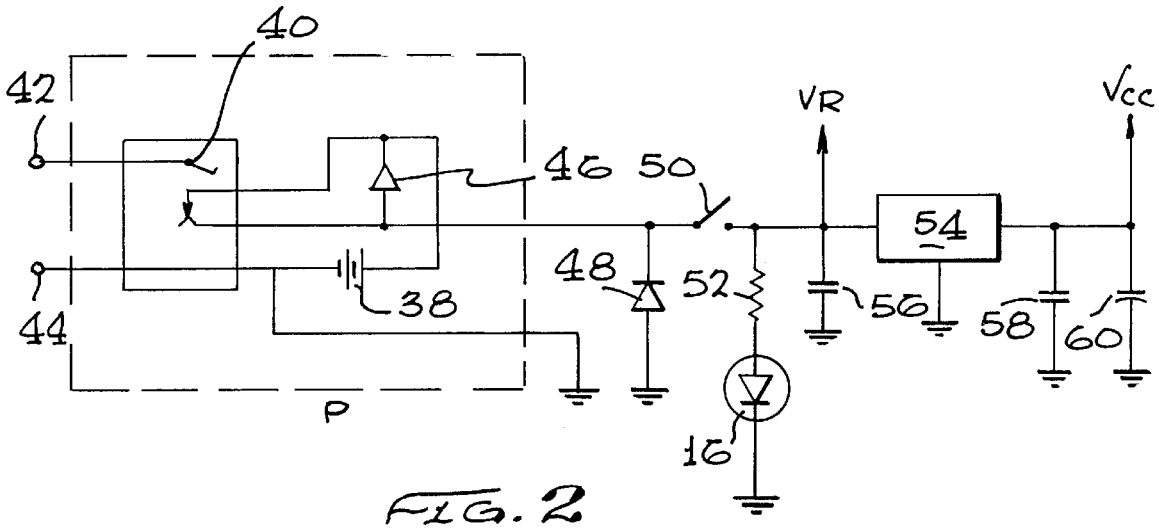
FIG. 2

SOUND IMAGER

REFERENCE TO RELATED APPLICATION(S)

This application claims benefit of U.S. Provisional Application No. 60/007,257 filed Oct. 30, 1995.

BRIEF SUMMARY OF THE INVENTION

The present invention relates to a device for providing a visual representation of the volume of sound. More particularly, it deals with the instantaneous and continuous generation of a visual image in which diverse colors are proportional to diverse levels of loudness of the human voice.

The acoustics of speakers' forums such as lecture halls, auditoriums, churches, etc., are often imperfect, and speakers must constantly monitor and adjust their voice volume to ambient conditions. In order to establish and maintain contact with the audience, they must be aware of the volume of their voice while they are speaking. The present invention provides a novel sound imager which displays various loudness levels as a series of chromatic lights. There is a definite need for apparatus which can supply such feedback instantly and continuously.

It is therefore a primary object of the present invention to provide a device which continually lets speakers see whether they are being heard by an audience.

It is another object of the present invention to provide speakers with a glare-less, instantaneous, continuous and dynamic feedback of the loudness of their voice without distracting them from concentrating on their speech.

It is another object to provide a device meeting the above objectives which is adaptable to be used on different support structures and which can easily be transported between different sites.

It is a further object to provide a device which improves on devices of the prior art in which feedback is typically expressed as numerical information.

Prior art patents known to applicant include the following.

U.S. Pat. No. 2,486,890 to R. W. Stanmyre has a vertical array of incandescent lamps which are sequentially energized by a power supply responsive to the volume of sound received by a microphone and converted into electrical energy. For subsequent measurements the indicator has to be reset to zero.

Aside from the fact that it appears to require external power from an ordinary convenience outlet and appears much too heavy and fragile to be easily portable, it is believed that the device of U.S. Pat. No. 2,486,890 requires that the speaker distinguish between different degrees of brightness depending on the number of lamps which are illuminated. Alternatively the speaker must distinguish between the number of lighted vs. unlighted lamps. Perception of relative brightness of an array of monochrome lamps weakens over time; the alternative, counting the number of lamps, is distracting and fatiguing.

U.S. Pat. No. 2,593,264 to Henry Schwartzberg discloses a sound control system in a moving picture theater. An operator in the projection booth is alerted by a buzzer when the sound in the theater is beyond a predetermined desirable range so that he can adjust the sound projector accordingly. The buzzer is actuated by a needle in a voltmeter which measures the voltage transmitted from a microphone. The audible information provided by the buzzer would be unacceptable for a speaker addressing an audience.

U.S. Pat. No. 4,277,980 to Coates et al discloses a signal processing element which detects and processes sound pressure waves into quantifiable electrical signals. The output consists of numerical or tactile information.

This patent teaches numerical or tactile output signals responding to the input of sound signals of varying volume. The visual display of rapidly changing numerals requires cognitive processing on the part of an observer. Absorbing tactile information is distracting because it requires an individual either to count the number of incident vibrations or to discriminate among the strengths of the inputs.

The subject of U.S. Pat. No. 3,597,542 is a variation of well known noise meters. Noise threshold is shown by the displacement of mercury in a mercury capillary tube.

U.S. Pat. No. 4,706,290 to Hong Yue Lin for Method and Apparatus Evaluating Auditory Distortion of an Audio System describes weighing and filtering networks for expressing data which represents auditory distortion characteristics of a audio system consistent with what is actually perceived by human ears. The disclosure concentrates on the frequency components of sound, not on its volume.

The present invention providing spectrographic light images as output signals is based on electrophysiological experiments on the neural-processing aspects of color. In a visual system the electrical activity of the retinal eye cells depends on the wave range of the stimulating light. The brain's capacity to process and absorb color images transdescends its capacity to process and absorb achromatic or numerical information. For a speaker who must give his full attention to the contents of his speech spectrographic signals of equal luminescence which are absorbed non-cognitively are far superior to numerical data.

In a preferred embodiment of the present invention, the intensity of sound, defined as the flow of energy per unit time in a specified direction through a unit area is represented by light of specified wavelength. The requisite detection and imaging apparatus includes a power supply, at least one transducer for receiving detection and imaging apparatus includes a power supply, at least one transducer for receiving acoustic signals and converting them into electric signals, at least one amplifier for amplifying the electric signals, a plurality a light emitting diodes (LEDS) which, upon receiving the electric signals emit radiation in the optically visible range, and circuit means operationally interconnecting all components to the power supply and onto another. In a preferred embodiment of the invention the emitted light ranges from green to near-infrared. The display is dynamic in that it presents information within a fraction of a second from the time it is received and continuously holds it until new information arrives.

The components of the apparatus according to the present invention are located in a housing in which a microphone is embedded so as to receive a speaker's acoustic signals. The power supply represented by a battery, and the electronic circuit components are mounted inside the housing whose hinged cover allows full access to the interior. LEDS are mounted as light bars in parallel array on a panel and are connectible, by means of a detachable multistrand conductor cable, with the electronic circuit inside the housing. When the cable is plugged into a designated socket on the exterior of the housing, the LEDS respond to the input of sound by emitting light of diverse wavelengths. The construction described heretofore is advantageous because of considerations of space. There is rarely adequate space on top of a podium or lectern to put anything down besides speaker's notes. Under such circumstances, the housing according to the present invention will have to be placed elsewhere, for example on the floor or on a shelf underneath the podium while the small LEDS panel at the end of a flexible cable may be put on the podium ledge or another available support in line-of-sight of a speaker, independent of the position of the housing. Detachable fastening means well known in the art may be attached to the panel to hold it in place.

When the housing is positioned distal from speakers, the fixed microphone will not receive the sound of their voices; under such circumstances a substitute microphone takes over. Similar to the LEDS arrangement, the substitute microphone is detachably connected by a flexible cable to the electronic circuit inside the housing and may be disposed proximate to a speaker so as to receive his or her acoustic signals independently of the housing's position. Plugging in the detachable microphone automatically cuts off input from the fixed microphone in order to avoid sound distortion by interference.

When not in use, the substitute microphone together with its cable can be stored inside the housing. Similarly, the LEDS panel and the cable to which it is attached may be housed in the housing when the apparatus is not in an operating mode.

An ON/OFF switch on the exterior of the housing connects or disconnects the circuit and the power supply; a status light is associated with the off-and-on switch.

The battery is rechargeable through an adapter/battery recharger which can be plugged into a socket on the exterior of the housing. When not in use the charger may also be stored inside the housing.

A manually rotatable knob on the exterior of the housing operates a potentiometer inside the housing to set a reference or null point for the display.

BRIEF DESCRIPTION OF THE DRAWINGS

This invention may be more clearly understood with the following detailed description and by reference to the drawings in which:

FIG. 1 is a perspective view illustrating the apparatus according to the present invention;

FIG. 2 is a schematic wiring diagram illustrating the power supply system for operating the apparatus according to the present invention.

DETAILED DESCRIPTION

Figure 3:
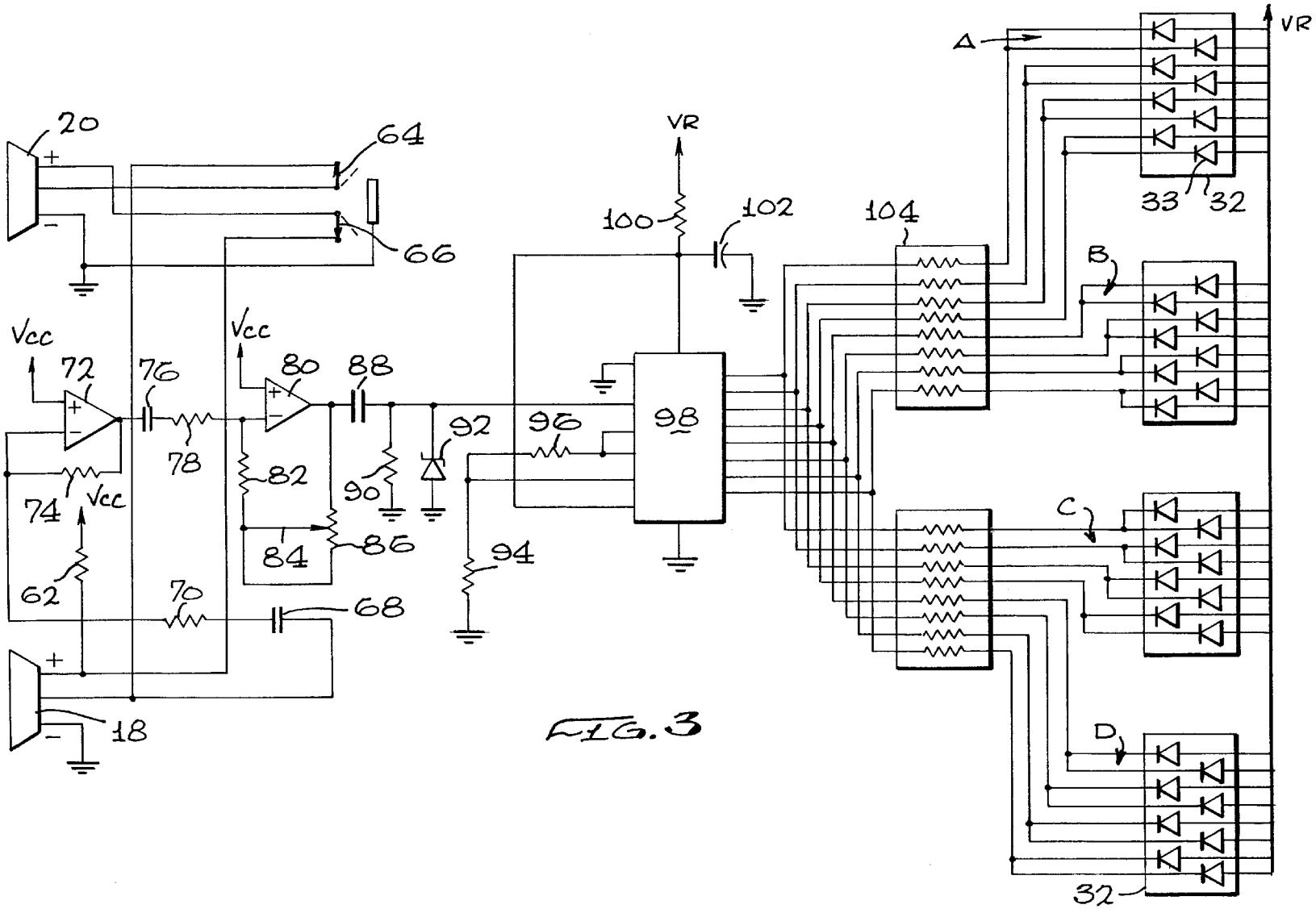
FIG. 3 is a schematic circuit diagram of one embodiment of the sound imaging apparatus of the present invention.

With reference to FIG. 1, a housing 10 is shown as a substantially rectangular container with a cover which is attached by a hinge 11. Two latches 12 (shown in phantom) hold the cover in place. Openings 13 in the cover and the body of the housing serve as heat dissipators. Controls 14 and 34 and connectors 24, 26 and 36 are seated on the housing exterior. The power supply and electronic circuit components are housed in the housing interior as will be described herebelow.

An ON/OFF switch 14 is actuatable to connect or disconnect the power supply from the circuit elements; associated with the switch 14 is a status light 16 to inform the speaker or operator that the power supply is energized.

A first microphone 18 is secured in an exterior wall of the housing 10 to receive acoustic signals from a speaker. A second microphone 20 is attached to one end of a conductor cable 22 which, at its other end can be plugged into socket 24 at the exterior of the housing 10. When microphone 20 is connected, microphone 18 is automatically disconnected. Another socket 26 is provided for detachably receiving therein one end of a multistrand conductor cable 28 which, at its opposite end is attached to a panel 30. The panel supports a plurality of light bars 32 consisting of light emitting diodes (LEDS) 33 in parallel array. When energized by acoustic signals transmitted by one of the two microphones 18 or 20 the light bars serially display light of diverse colors, that is, light of diverse wave length. Each color corresponds to a predetermined loudness level. In the illustration of FIG. 1, the light bars 32 at the center of the panel display green light, indicating weak sound signals; the light bars on either side of the green emit red light when louder sounds are sensed.

A potentiometer control knob 34 on the exterior of the housing 10 cooperates with a potentiometer 86 interposed in the circuit as described below. A socket 36, also provided on the housing exterior, is provided to receive therein a battery charger (not shown) which may be housed inside the housing 10 when it is not being used.

The flexibility of the sound imager, as represented by the detachable light bar panel 30, enables the latter to be placed in the speaker's line of sight, independent of the placement of the housing. The movable microphone 20 serves a similar purpose; it can be placed where it receives the speaker's acoustic signals, independent of the placement of the housing with the built-in microphone 18.

When not being used, the detachable microphone 20, the light bar panel 30 and their respective cables and an optional adaptor/battery charger may be stored inside the housing 10, providing a compact unit which can be deployed and carried from site to site with a minimum of effort.

Referring to FIG. 2, a power supply for the system, shown in dashed lines and denoted by the letter P, includes a rechargeable battery 38 which may be of the lead-acid type. The battery supplies 12vdc current, denoted by the letters VR. Alternatively, power may be drawn from readily available 120vac current through an intermediary AC adaptor/battery charger (not shown but connected to socket 39). If the adaptor is installed, the battery 38 is disconnected through the switch 40. To recharge, a commercially available adaptor typically rated for 12vdc at 300 ma, is plugged at one of its ends into a conventional wall 120vac terminal and is connected at the other of its ends through the socket 36 to leads 42 and 44. While the adaptor is in place the battery 38 is recharging through a first diode 46 which may be of the 1IN4001 type or equivalent. A second diode 48, also of the 1IN4001 type or equivalent protects the battery 38 against damage which may be inflicted by an adaptor lacking negative tip orientation.

A movable arm 50 connects or disconnects the power supply upon manual actuation of the ON/OFF switch 14 on the housing 10. In the connect or "ON" state a voltage divider 52 divides the 12v dc-current to transmit 2vdc to the status light 16 which may be a light emitting diode. The voltage divider is a resistor which may have a value of 3 kΩ. A 5v positive voltage regulator 54 provides a steady 5v dc current denoted by VCC regardless of circuit conditions. The voltage regulator may be of the L7805CV type or equivalent. Capacitors 56, 58 and 60 remove transients from the input and output pins of the voltage regulator 54. Capacitor 56 has a capacitance of 1 microfarad, capacitor 58 has a capacitance of 0.1 microfarad, and capacitor 60 has a capacitance of 22 microfarad.

Referring now to FIG. 3, the auditory signals are received by either of two microphones 18 or 20 which may be of the omni-directional electret condenser type with a frequency response of 50 hz–10 khz. Microphone 18 which is affixed to the housing 10 is considered to be the primary microphone, and the detachable microphone 20 is considered to be a substitute for microphone 18 if the latter cannot receive a speaker's auditory signals. The microphones 18 and 20 are connected between the 5vdc power supply VCC and a ground or common. A resistor 62 intermediate the power supply and the microphones provides proper bias for the latter. The resistor 62 may have a value of 3.9 kΩ. Activation of microphone 20 uncouples a pair of contacts 64 and 66 whereby microphone 18 will be disconnected to avoid sound distortion by interference from the latter.

A signal passed on by either of the two microphones is transmitted to a first amplifier 72 which may be an operational amplifier of the LM324 type or equivalent. Its negative input terminal is connected to either of the microphones 18 or 20 through a capacitor 68 in series with a resistor 70. The positive input terminal of amplifier 72 is connected to the 5vdc supply VCC. The capacitor 68 may have a capacitance of 0.1 microfarad, and the resistor 70 may have a value of 10 kΩ. A feedback loop between the output of the amplifier 72 and its negative input includes a resistor 74 which may have a value of 825 kΩ. This provides a voltage gain at the output of amplifier 72 which amounts to 82.5. The increase in voltage not only provides the circuit with instant response but facilitates the detection of very weak auditory signals.

The amplified signal is passed on via a capacitor 76 in series with a resistor 78 to the negative input terminal of a second amplifier 80. The capacitor 76 may have a capacitance of 1 microfarad, and the resistor 78 may have a value of 10 kΩ. The amplifier 80 which may be of the LM324 type or equivalent receives 5vdc current through its positive input terminal. The 5vdc current supplied to the positive input terminals of amplifiers 72 and 80 sets up a 5v reference signal around which the microphone signal is passed. The feedback loop between the output of amplifier 80 and its negative input includes a potentiometer 86 such as is well known in the art. The total resistance of the potentiometer 86 may have a value of 100 kΩ. A control arm 84 for the potentiometer is movable by rotating the control knob 34 on the exterior of the housing 10. The range of voltage adjustments on the potentiometer provides a corresponding range of responses on the part of the LEDS to loudness signals, from soft murmurs on up to very loud voices. A resistor 82 in the feedback loop is coupled to the control arm 84 and sustains the response of the system, even if the knob 34 is set at zero. In the absence of any acoustic signal, that is, if there is no signal input into the amplifier 80, the circuit between the microphones 18 or 20 and the image output is severed by the capacitor 88 and the resistor 90. The capacitor 88 may have a capacitance of 0.33 microfarad, and the resistor 90 may have a value of 1 MΩ. The negative half cycles of the signal are removed by a Zener diode 92 which clamps the signal at −0.7v, removing the negative half-cycles. The Zener diode may be of the type IN5818 or its equivalent. A light bar display driver 98 is energized by the 12vdc power supply VR; the driver which may be of the LM3915 type supplied by National Semiconductor or its equivalent responds to the positive half cycles of a signal. Each of the several output segments of the driver 98 responds to a 3 dB difference in voice volume, so that, if the driver has 10 output segments, the total output covers a range of 30 dB. Driver 98 is shown having eight output segments covering a range of 24 dB in voice volume. Resistors 94 and 96 cause the driver 98 to deliver 15 mA of current to each output segment. The resistor 94 may have a value of 7.32 kΩ and the resistor 96 may have a value of 1.1 kΩ. A third resistor 100 intermediate the power supply VR and the driver 98 and which may have a value of 10 kΩ is in series with a capacitor 102. The capacitor 102 which may have a capacitance of 2.2 microfarad removes oscillations which could cause fluttering in the visual display. In a preferred embodiment the capacitor 102 is connected to ground.

The eight output segments of the driver 98 are available to provide a visual image of the loudness of sound. Each segment drives two light bars 32, adding up to a total of sixteen; each light bar comprises two LEDS 33. The driver 98 is connected to each of the sixteen light bars 32 through one of sixteen limiting resistors 104 each of which may have a value of 100 kΩ. The resistors which are parallel to one another are divided into two groups of eight each. The LED display is a configuration of four units, respectively denoted by the letters A,B,C and D. Each of the units comprises eight LEDS for a total display of 32. In a preferred embodiment of the present invention the LEDS in units B and C emit green light, whereas the LEDS in units A and D emit red light. LEDS emitting other colors may be added to, or substituted for, the green and red recited by way of example only.

The light bars 32 of the units B and C which emit green light are disposed parallel to one another in a row. The center of the row coincides with the center of the panel. The light bars of the units A and D which emit red light border the green light bars on either side of the row. Under the control of the light bar driver 98 the units B and C are energized by relatively low sound; an increase in the sound level activates the units A and D to display red light. The green and the red units become visible or invisible in sequence, depending on changes in signal strength, that is on changes in the loudness of a speaker's voice. When all light bars 32 are fully energized the total amount of current drawn by the system amounts to 95–100 ma, and the power dissipation is 1.2 W.

As described in the foregoing, the sound imager of the present invention is an assembly of components which are either widely available on the market, or are easily formed and assembled by those skilled in the art. All components are compatible with the integrated circuit by which they are connected to one another. The apparatus is compact, lightweight but rugged and easily portable.

The above described embodiments of the present invention are merely descriptive of its principles and are not to be considered limiting. The scope of the present invention instead shall be determined from the scope of the following claims including their equivalents.

I claim:

1. A sound imager for visually displaying the volume of acoustic signals comprising a power supply;

transducer means connected to said power supply for receiving said signals and converting them into a voltage which corresponds to the level of sound of said signals;

amplifying means connected to said transducer means for amplifying said voltage;

signal processing means connected to said amplifying means;

a display driver connected to said signal processing means; and display means adapted to receive voltage from said display driver to display a spectrographic image in which diverse colors correspond to predetermined levels of sound;

said signal processing means including capacitance means connected to receive the output of said amplifying means such that in the absence of said acoustic signals, said display means have no output.

2. A sound imager as claimed in claim 1 in which said amplifying means comprise a first amplifier, a second amplifier connected to said first amplifier for further amplifying said voltage, said signal processing means includes a voltage regulator connected to said second amplifier and a display driver interposed between said voltage regulator and said display means for establishing a threshold signal for said display means.

3. A sound imager as claimed in claim 1 in which said display means comprises a plurality of light emitting diodes arrayed as a series of light bars for the progressive display of a spectrographic image.

4. A sound imager as claimed in claim 3 in which said light bars and said display driver are detachably connected to said signal processing means and said amplifying means.

5. A sound imager as claimed in claim 1 wherein said transducer means comprise a first microphone and a second microphone, wherein said second microphone is detachably connectible to said power supply, and wherein the connection between said first microphone and said power supply is broken off upon connection of said second microphone to said power supply.

6. A sound imager as claimed in claim 1 wherein said signal processing means includes a potentiometer operable as a gain control for said display means.

7. A sound imager as claimed in claim 1 wherein said signal processing means includes a potentiometer operable as a gain control for said display means.

8. A sound imager as claimed in claim 1 wherein said display driver receives analog voltage level signals and provides a plurality of output signals representing a logarithmic 3 dB per step variation in volume of said acoustic signals.

9. A sound imager for displaying the volume of acoustic signals comprising transducer means for receiving said acoustic signals and converting them into a voltage varying with the sound level of said acoustic signals;

said transducer means comprising a first microphone and a second microphone, said second microphone being detachably connectible to said power supply such that said first microphone is disconnected from said power supply upon connection of said second microphone to said power supply;

amplifier means connected to receive said voltage including a first amplifier and a second amplifier connected to said first amplifier for amplifying said voltage;

signal processing means including a voltage regulator connected to said second amplifier;

a display driver connected to receive the output of said signal processing means and to produce a plurality of output signals depending upon the magnitude of said voltage; and display means adapted to receive output signals from said display driver to display a spectrographic image in which diverse colors correspond to predetermined sound levels.

10. A sound imager as claimed in claim 9 wherein said display means comprises a plurality of light emitting diodes connected to said display driver and arrayed for the progressive display of a spectrographic image.

11. A sound imager as claimed in claim 9 wherein said signal processing means includes a feedback loop around said second amplifier, said loop including a potentiometer operative as a gain control for said display means.

12. A sound imager as claimed in claim 9 wherein said signal processing means include capacitance means connected to receive the output of said amplifier means such that in the absence of said acoustic signals, said display means have no output.

* * * * *